US009433986B2

(12) United States Patent
Ogawa et al.

(10) Patent No.: US 9,433,986 B2
(45) Date of Patent: Sep. 6, 2016

(54) ROLLING MILL ROLL-CLEANING DEVICE AND CLEANING METHOD

(75) Inventors: Muneshige Ogawa, Kitakyusyu (JP); Hisamoto Wakabayashi, Kitakyusyu (JP); Makoto Katsube, Kitakyusyu (JP); Hiroshi Nishikawa, Kitakyusyu (JP)

(73) Assignees: NIPPON STEEL & SUMIKIN ENGINEERING CO., LTD., Tokyo (JP); NS PLANT DESIGNING CORPORATION, Fukuoka (JP)

( * ) Notice: Subject to any disclaimer, the term of this patent is extended or adjusted under 35 U.S.C. 154(b) by 223 days.

(21) Appl. No.: 13/982,006

(22) PCT Filed: May 15, 2012

(86) PCT No.: PCT/JP2012/062340

§ 371 (c)(1),
(2), (4) Date: Jul. 26, 2013

(87) PCT Pub. No.: WO2012/157619

PCT Pub. Date: Nov. 22, 2012

(65) Prior Publication Data

US 2013/0305799 A1 Nov. 21, 2013

(30) Foreign Application Priority Data

May 16, 2011 (JP) ..... 2011-109481

(51) Int. Cl.
*B21B 28/04* (2006.01)
*B21B 45/02* (2006.01)
(Continued)

(52) U.S. Cl.
CPC ..... *B21B 45/0275* (2013.01); *B05B 7/0408* (2013.01); *B05B 12/12* (2013.01);
(Continued)

(58) Field of Classification Search
CPC ..... B21B 28/00; B21B 28/02; B21B 28/04; B21B 45/02; B21B 45/0269; B21B 45/0275; B21B 45/0287; B21B 27/10; B21B 45/04; B05B 1/02; B05B 7/02; B05B 13/04; B05B 13/041; B05B 7/0408; B05B 7/06; B05B 7/061; B08B 3/024; B08B 2203/0288
USPC ..... 72/236
See application file for complete search history.

(56) References Cited

U.S. PATENT DOCUMENTS 2,551,276 A * 5/1951 McMahan ..... B05B 7/061 239/400
3,505,844 A * 4/1970 McLean ..... C10M 173/02 72/42

(Continued)

FOREIGN PATENT DOCUMENTS

CN 101700532 5/2010
DE 19848174 A1 5/2000

(Continued)

OTHER PUBLICATIONS

Chinese Office Action dated Nov. 4, 2014 issued in the corresponding Chinese patent application No. 201280011174.7.; Partial English translation included.

(Continued)

*Primary Examiner* — Edward Tolan
(74) *Attorney, Agent, or Firm* — Rankin, Hill & Clark LLP

(57) ABSTRACT

Generation of cavitation jet in air on a surface of a work roll provides a higher cleaning force than squirting of only high pressure fluid, so that sticking substances on the surface of the work roll are reliably removable. When a distance between a cleaning nozzle and the surface of the work roll and pressure of the high pressure fluid are controlled within a predetermined range, sticking substances are efficiently removable while roughness of the surface of the work roll is maintained.

7 Claims, 5 Drawing Sheets

(51) Int. Cl.

| | |
|---|---|
| ***B05B 7/04*** | (2006.01) |
| ***B08B 3/02*** | (2006.01) |
| ***B05B 15/10*** | (2006.01) |
| ***B05B 12/12*** | (2006.01) |
| ***B05B 13/04*** | (2006.01) |
| *B05B 7/06* | (2006.01) |

(52) U.S. Cl.
CPC ..... *B05B 13/041* (2013.01); *B05B 15/10* (2013.01); *B08B 3/024* (2013.01); *B21B 28/04* (2013.01); *B05B 7/061* (2013.01); *B08B 2203/0288* (2013.01)

(56) References Cited

U.S. PATENT DOCUMENTS

| | | | | | |
|---|---|---|---|---|---|
| 5,056,718 | A * | 10/1991 | Wakefield | B05B 1/10 | 239/441 |
| 5,086,974 | A * | 2/1992 | Henshaw | B05B 1/34 | 175/424 |
| 5,212,975 | A * | 5/1993 | Ginzburg | B21B 27/10 | 239/562 |
| 5,460,023 | A * | 10/1995 | Ginzburg | 72/43 | |
| 5,897,062 | A * | 4/1999 | Enomoto et al. | 239/590 | |
| 6,079,073 | A * | 6/2000 | Maekawa | B08B 1/007 | 15/102 |
| 6,643,882 | B1 * | 11/2003 | Sotozaki | B08B 1/007 | 15/102 |
| 6,923,385 | B2 * | 8/2005 | Koponen | B05B 7/061 | 239/422 |
| 7,367,518 | B2 * | 5/2008 | Tanigaki et al. | 239/601 | |
| 2001/0007200 | A1 | 7/2001 | Ravenet et al. | | |
| 2003/0013388 | A1 * | 1/2003 | Buttram | B24B 5/167 | 451/49 |
| 2004/0177655 | A1 * | 9/2004 | Kodera | B08B 1/04 | 68/19 |
| 2010/0089112 | A1 * | 4/2010 | Uijtdebroeks et al. | 72/201 | |
| 2011/0168215 | A1 * | 7/2011 | Anglade | 134/198 | |
| 2012/0017660 | A1 * | 1/2012 | Kuroki | B21B 45/08 | 72/39 |
| 2013/0233040 | A1 * | 9/2013 | Butler | C21D 7/06 | 72/56 |

FOREIGN PATENT DOCUMENTS

| | | | | | |
|---|---|---|---|---|---|
| JP | 55-022434 | | 2/1980 | | |
| JP | 6114418 | A2 | 4/1994 | | |
| JP | A-11-244905 | | 9/1999 | | |
| JP | B2-3039895 | | 3/2000 | | |
| JP | 2000-117317 | * | 4/2000 | B21B 45/02 | |
| JP | A-2000-271615 | | 10/2000 | | |
| JP | U-3079688 | | 6/2001 | | |
| JP | A-2003-62492 | | 3/2003 | | |
| JP | A-2003-285114 | | 10/2003 | | |
| JP | 2005-34908 | A * | 2/2005 | B21B 45/08 | |
| JP | A-2005-152935 | | 6/2005 | | |
| JP | A-2007-260550 | | 10/2007 | | |
| RU | 2287386 | C2 | 11/2006 | | |
| SU | 621416 | T | 8/1978 | | |
| WO | 2005/120739 | | 12/2005 | | |

OTHER PUBLICATIONS

International Search Report issued in International Patent Application No. PCT/JP2012/062340 dated Jun. 12, 2012.
Russian Notice of Allowance dated Mar. 18, 2016 issued in the corresponding Russian patent application No. 2013155672 and its English translation thereof.

* cited by examiner

ROLLING MILL ROLL-CLEANING DEVICE AND CLEANING METHOD

TECHNICAL FIELD

The present invention relates to a cleaning device of a rolling roll and a cleaning method thereof.

BACKGROUND ART

In a hot-dip continuous galvanizing line or the like, a galvanized steel strip is rolled by work rolls and is subjected to skin pass mill rolling to provide an appropriate steel-roughness to a galvanized surface of the steel strip. In such a skin pass mill, when the galvanized steel strip is rolled, a part of the galvanized layer is peeled off to generate sticking substances (e.g., zinc powders). The sticking substances are adhered on surfaces of the work rolls on which convex and concave portions are formed to provide steel-roughness. The adhered sticking substances are accumulated in the concave portions to reduce roughness of the surfaces of the work rolls, resulting in clogging of the work rolls. Because of the clogging of the work rolls, necessary steel-roughness is not given to a hot-dip galvanized steel strip after the skin pass mill rolling, so that press moldability and image clarity requisite when the hot-dip galvanized steel strip is used as an automobile member and the like cannot be secured. For this reason, there has been used a typical cleaning method of removing sticking substances (e.g., zinc powders) by scratching a surface of a work roll with a contact-type cleaning brush or the like. However, in such a case, the surface of the work roll is scraped to reduce surface roughness.

Accordingly, there has been proposed a cleaning method of removing sticking substances with surface roughness of the work roll kept at a predetermined condition (see, for instance, Patent Literatures 1 to 3).

A skin pass mill disclosed in Patent Literatures 1 and 2 includes opposing cleaning nozzles spaced at a predetermined distance from surfaces of work rolls. High pressure fluid is squirted over the surfaces of the work rolls through the cleaning nozzles and sticking substances are blown out and removed by the pressure of the high pressure fluid. Examples of the high pressure fluid used in such a cleaning device include rolling oil, air, oil mist and hot water.

A skin pass mill disclosed in Patent Literature 3 coats rust preventive oil on a surface of a to-be-rolled galvanized steel strip before rolling, thereby preventing adhesion of sticking substances on a surface of a work roll and keeping surface roughness of the work roll.

On the other hand, unlike the method of Patent Literatures 1 and 2 in which only high pressure fluid is squirted through the cleaning nozzles, there has been proposed a cleaning method using cavitation jet in air (see, for instance, Patent Literature 4).

According to the cleaning method disclosed in Patent Literature 4, high pressure water is squirted from the center of a nozzle while low pressure water is squirted from the surroundings around the center, so that cavitation phenomenon is generated at a position where high pressure water and low pressure water collide, thereby cleaning an object. The cleaning method using such cavitation jet in air can provide higher cleaning effects than the cleaning methods disclosed in Patent Literatures 1 and 2 using the high pressure fluid, even when the pressure of the high pressure water is not set at such a high pressure.

CITATION LIST

Patent Literature(s)

Patent Literature 1 JP-A-2003-285114
Patent Literature 2 JP Patent No. 3039895
Patent Literature 3 JP-A-2005-152935
Patent Literature 4 JP-A-2003-62492

SUMMARY OF THE INVENTION

Problems to be Solved by the Invention

However, in the cleaning methods disclosed in Patent Literatures 1 and 2 using high pressure fluid, cleaning performance is not sufficiently increased since the pressure of the fluid is limited, so that sticking substances (e.g., zinc powders) accumulated in concave portions on the surface of the work roll cannot be sufficiently removed. On the other hand, when the pressure of the fluid is excessively increased, the surface of the work roll is scraped to lose surface roughness. Moreover, during the rolling, since the high pressure fluid is constantly squirted over an axially full length of the work roll, a large volume of cleaning waste fluid containing the removed sticking substances are generated, which entails high costs to dispose the cleaning waste fluid.

Moreover, since the rust preventive oil needs to constantly exist between the work roll and the galvanized steel strip in the method disclosed in Patent Literature 3, a large volume of waste fluid is generated, which entails high costs to dispose the cleaning waste fluid.

On the other hand, since the method disclosed in Patent Literature 4 using cavitation jet in air is not for cleaning work rolls of a skin pass mill, development of a cleaning method for obtaining cleaning effects in cleaning the work roll has been desired.

An object of the invention is to provide cleaning equipment of a rolling roll capable of reliably removing sticking substances on a surface of the rolling roll and keeping surface roughness of the rolling roll, and a cleaning method of the rolling roll.

Means for Solving the Problems

A cleaning device for a rolling roll according to an aspect of the invention includes a cavitation nozzle that is used for cleaning a work roll used in a rolling machine, in which, in order to clean zinc adhered to a surface of the work roll while keeping surface roughness of the work roll, a distance X between a tip end of the cavitation nozzle and the surface of the work roll is set in a range of 30 mm to 100 mm; a pressure PH of high pressure fluid squirted from the cavitation nozzle is set in a range of 20 MPa to 40 MPa; and the pressure PH of the high pressure fluid satisfies $PH \leq 0.375X + 25$.

According to the above aspect of the invention, the high pressure fluid and low pressure fluid are separately squirted from a cleaning nozzle to generate cavitation jet in air, so that a higher cleaning force is obtainable than squiring of only the high pressure fluid and sticking substance on the surface of the work roll are reliably removable. Further, since the distance X between the tip end of the cleaning nozzle and the surface of the work roll and the pressure PH of the high pressure fluid are set within the respective ranges in which high cleaning effects are obtainable, sticking substance are efficiently removable while the roughness of the surface of the work roll is maintained. Specifically, when the distance X is shorter than 30 mm, water squirted from the nozzle splashes and rebounds to disturb generation of cavitation. When the distance X is longer than 100 mm, the cleaning effects of the work roll are reduced, so that a further higher pressure is required to increase the cleaning effects. On the other hand, in terms of the relation between the squirting distance and the pressure, when the pressure is lower than 20 MPa, sticking substance adhered on the surface of the work roll cannot be removed. When the pressure is higher than 40 MPa and the squirting distance is between 30 mm and 100 mm, the surface of the work roll is scraped to reduce the surface roughness of the work roll. Consequently, the roughness transferred to the steel strip is not sufficient for the demand to adversely affect aftertreatment of the steel strip, thereby necessitating replacement of the work roll.

In the cleaning device according to the above aspect of the invention, the distance X and the pressure PH are set so as to satisfy the following formula (1).

$$PH \leq 0.375X+25 \quad (1)$$

With this arrangement, since the distance X is set to fall within the range of 30 mm to 100 mm and the pressure PH of the high pressure fluid is set to become smaller than 40 MPa in proportion to the distance X in PH≤0.375X+25, squirting of the high pressure fluid at a close distance and under a high pressure is restricted, so that splash of the fluid is further restrained and the roughness of the surface of the work roll is maintainable. When the high pressure fluid is squirted at a close distance and under a high pressure, the fluid rebounding from the surface of the work roll breaks cavitation to reduce the cleaning effects. Accordingly, cleaning under the conditions to satisfy the formula (1) enables to ensure the cleaning effects.

According to another aspect of the invention, a method of cleaning a work roll of a rolling roll using a cavitation nozzle includes: setting a distance X between a tip end of the cavitation nozzle and a surface of the work roll at a predetermined distance in a range of 30 mm to 100 min; setting a pressure PH of high pressure fluid squirted from the cavitation nozzle at a predetermined value in a range of 20 MPa to 40 MPa; and cleaning zinc adhered on the surface of the work roll while keeping roughness of the surface of the work roll, by squirting the high pressure fluid from the cavitation nozzle in which the pressure PH of the high pressure fluid is set to satisfy PH≤0.375X+25.

In the above aspect of the invention, it is preferable that the method further includes moving the cleaning nozzle along the surface of the work roll while keeping the distance X for cleaning.

In the above aspect of the invention, generation of cavitation jet in air on the surface of the work roll in the same manner as in the above cleaning device provides a higher cleaning force than squirting of only the high pressure fluid, so that sticking substances on the surface of the work roll are reliably removable. In addition, since the distance X between a tip end of the cleaning nozzle and the surface of the work roll and the pressure PH of the high pressure fluid are respectively set within appropriate ranges, sticking substances are efficiently removable while the roughness of the surface of the work roll is maintained.

Moreover, since the cavitation nozzles are arranged so as to squirt the fluid toward the axial center of the work roll, sticking substances adhered in the concave portions can be efficiently cleaned.

According to the cleaning device and the cleaning method of the rolling roll according to the above aspects of the invention, since sticking substances are efficiently removable while the roughness of the surface of the work roll is maintained, clogging resulting in the reduced roughness of the surface of the work roll can be restricted, a maintenance interval can be prolonged by decreasing a replacement frequency of the work roll, and a rolling efficiency of the skin pass mill can be increased. Accordingly, steel-roughness requisite to a hot-dip galvanized steel strip after the skin pass mill rolling can be continuously provided, thereby efficiently manufacturing a galvanized steel strip having secured press moldability and clarity requisite for use as an automobile member.

DESCRIPTION OF EMBODIMENT(S)

Exemplary embodiment(s) of the invention will be described below with reference to the attached drawings.

Arrangement of Skin Pass Mill

Figure 1:
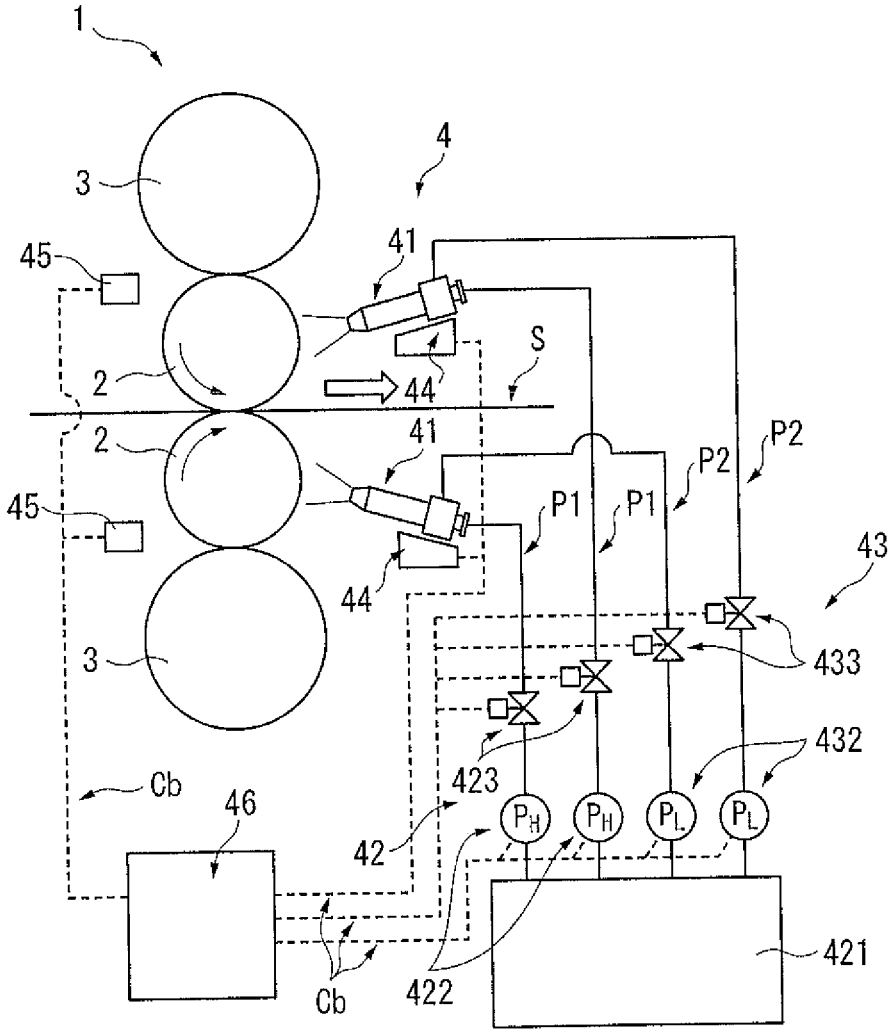
FIG. 1 is a schematic configuration of a skin pass mill according to an exemplary embodiment of the invention.

As shown in FIG. 1, a skin pass mill 1 includes: a pair of work rolls 2 that are vertically aligned; backup rolls 3 that are vertically aligned in such a manner as to interpose the work rolls 2; and a cleaning device 4 that cleans a surface of each of the work rolls 2. The pair of work rolls 2 perform the skin pass mill rolling for a galvanized steel strip S that is supplied from an entry side of the work rolls 2 (on the left in FIG. 1) and transfer out the steel strip S through a delivery side of the work rolls 2 (on the right in FIG. 1).

Arrangement of Cleaning Device

The cleaning device 4 cleans surfaces of the work rolls 2 by squirting high pressure fluid and low pressure fluid onto the surfaces and includes a cleaning nozzle 41, a high pressure fluid supplier 42, a low pressure fluid supplier 43, a cleaning nozzle moving unit 44, a detector 45 and a controller 46. As shown in FIG. 1, the cleaning nozzle 41 is disposed near the delivery side of each of the work rolls 2 and is connected to the high pressure fluid supplier 42 through a pipe P1 and to the low pressure fluid supplier 43 through a pipe P2.

The high pressure fluid supplier 42 supplies the high pressure fluid to the cleaning nozzle 41 and includes a cleaning fluid storage 421, a first pumping unit 422 and a first adjusting unit 423. The cleaning fluid storage 421 is provided by a tank or a cylinder in which cleaning fluid such as water or rolling oil is stored. The cleaning fluid storage 421 is connected to the cleaning nozzle 41 through the pipe P1. The first pumping unit 422, which is provided by a high pressure pump and disposed in the pipe P1, is controlled by the controller 46 to pressurize the cleaning fluid supplied from the cleaning fluid storage 421 to provide high pressure fluid and supply the high pressure fluid to the cleaning nozzle 41. The first adjusting unit 423 is, for instance, a pressure adjuster including a valve and a pressure gauge and is disposed near a first nozzle of the first pumping unit 422 in the pipe P1. The first adjusting unit 423 serves as a pressure adjuster that controls pressure, for instance, by controlling a rotation speed of a motor of a high pressure pump (i.e., the first pumping unit 422). The first adjusting unit 423 is controlled by the controller 46 to adjust a supply volume and a supply pressure of the high pressure fluid fed from the first pumping unit 422.

The low pressure fluid supplier 43 supplies the low pressure fluid to the cleaning nozzle 41 and includes the cleaning fluid storage 421, a second pumping unit 432 and a second adjusting unit 433. Since the same cleaning fluid is used as the high pressure fluid and the low pressure fluid in this exemplary embodiment, the cleaning fluid storage 421 described with reference to the high pressure fluid supplier 42 can be used. Accordingly, the cleaning fluid storage 421 is also connected to the cleaning nozzle 41 through the pipe P2. Note that, when cleaning fluid different from the high pressure fluid is used as the low pressure fluid, another storage (not shown) is separately provided for storing the cleaning fluid as the low pressure fluid. The second pumping unit 432 is a low pressure pump and is disposed in the pipe P2. The second pumping unit 432 is controlled by the controller 46 to pressurize the cleaning fluid supplied from the cleaning fluid storage 421 to provide low pressure fluid and supply the low pressure fluid to the cleaning nozzle 41. The second adjusting unit 433 is, for instance, a pressure adjuster including a valve and a pressure gauge and is disposed near a second nozzle of the second pumping unit 432 in the pipe P2. The second adjusting unit 433 serves as a pressure adjuster that controls pressure, for instance, by controlling a rotation speed of a motor of a high pressure pump (i.e., the second pumping unit 432). The second adjusting unit 433 is controlled by the controller 46 to adjust a supply volume and a supply pressure of the low pressure fluid fed from the second pumping unit 432.

The detector 45 detects surface conditions of each of the work rolls 2 and transmits information corresponding to the surface conditions to the controller 46. Examples of elements for showing the surface conditions of each of the work rolls 2 include surface roughness, surface color, surface temperature and conditions where sticking substances are adhered on the surfaces of the work rolls 2. The detector 45 detects at least one of the elements for showing the surface conditions. For instance, for detecting the surface roughness of the work rolls 2, the detector 45 includes a surface roughness measuring device, by which the detector 45 measures a change in the surface roughness of the work rolls 2 and detects whether sticking substances are adhered or accumulated in concave portions. Moreover, for instance, for detecting the surface color of the work rolls 2, the detector 45 includes a camera and an image analyzing unit, by which the detector 45 detects a change in the surface color caused by adhesion of zinc powders, and adhesion of sticking substances. In addition to the above, for instance, for detecting the surface temperature of the work rolls 2, the detector 45 includes a non-contact type temperature sensor, by which the detector 45 detects whether the surface temperature exceeds a temperature at which an inhibiting action against adhesion of zinc powders works.

The controller 46 is connected to the detector 45, the first adjusting unit 423, the second adjusting unit 433, the first pumping unit 422, the second pumping unit 432 and the cleaning nozzle moving unit 44 through electric wiring Cb, and controls switching of squirt conditions of squirt liquid by the cleaning device 4, a pressure and a flow rate of the fluid, and a position and oscillation of the cleaning nozzle 41 based on the surface conditions of the work rolls 2 detected by the detector 45. Note that the detector 45 and the controller 46 are not limited to various devices, but the detector 45 may be replaced with visual check by an operator and the controller 46 may be replaced with manual control by the operator.

Figure 2:
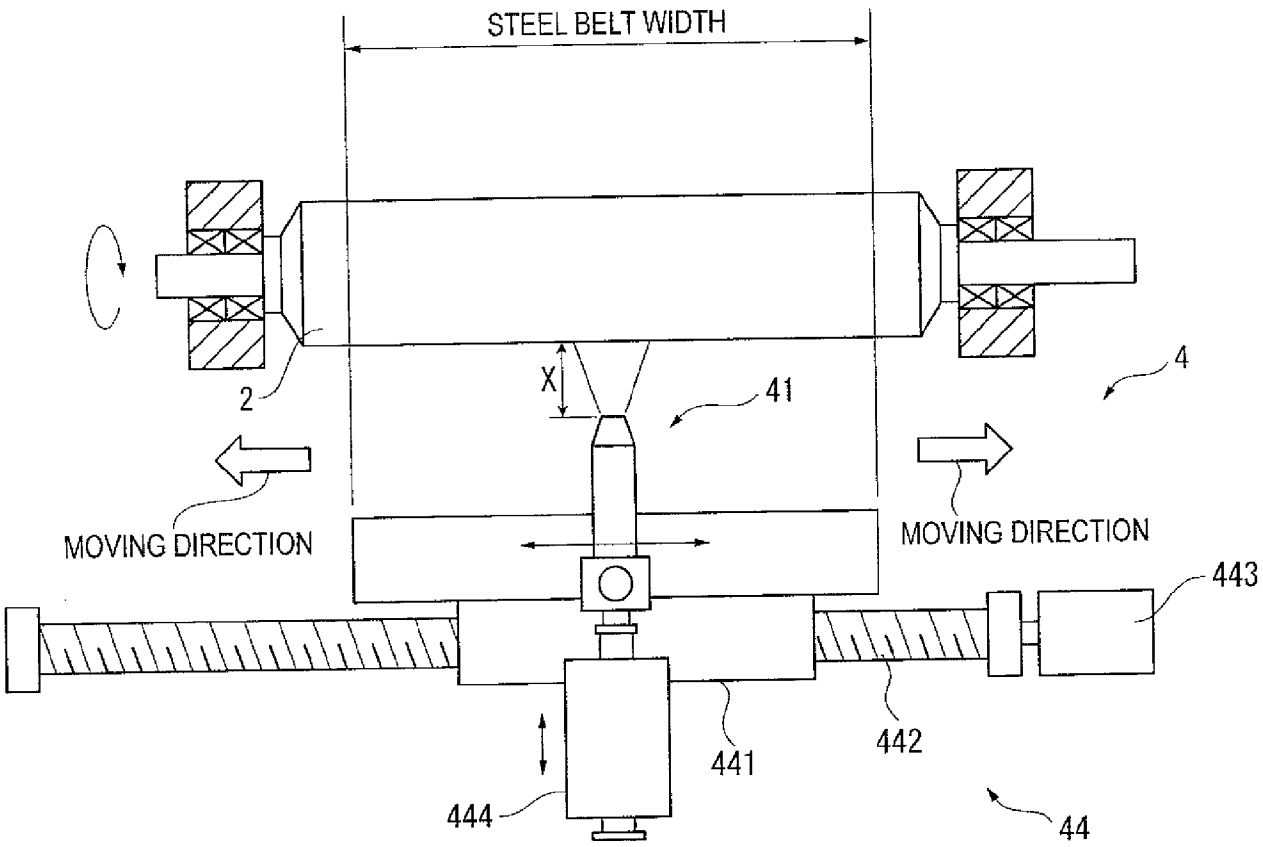
FIG. 2 is a schematic illustration of a cleaning device of the skin pass mill.
Figure 3:
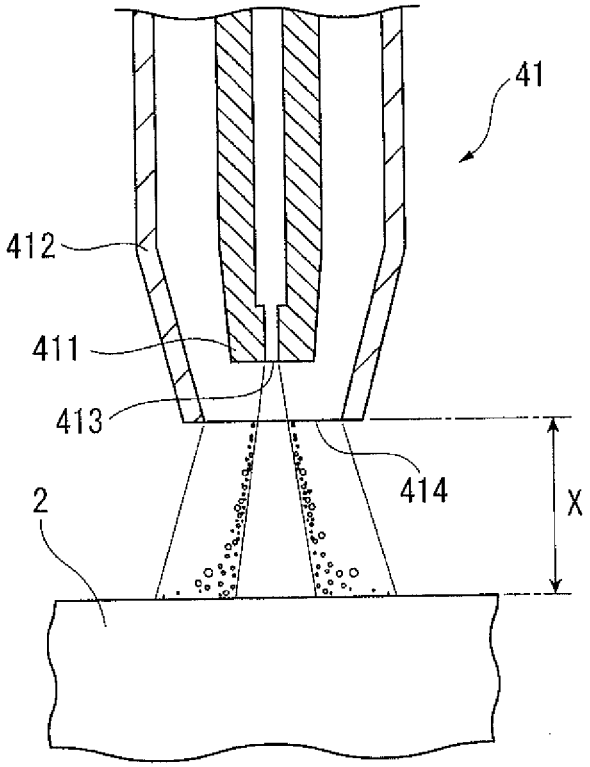
FIG. 3 is a partial cross-section showing a cleaning nozzle of the cleaning device.

As shown in FIG. 2, the cleaning nozzle 41 is singularly attached to the cleaning nozzle moving unit 44 in an axial direction of each of the work rolls 2. As shown in FIG. 3, the cleaning nozzle 41 includes a tubular first nozzle 411 and a tubular second nozzle 412 surrounding the first nozzle 411. At the tip end, the first nozzle 411 has a first squirt hole 413 capable of squirting high pressure fluid fed from the high pressure fluid supplier 42. The second nozzle 412 is provided in such a manner as to concentrically surround the first nozzle 411 to form a double tube. At the tip end, the second nozzle 412 has a second squirt hole 414 capable of squirting low pressure fluid fed from the low pressure fluid supplier 43. A pressure of the high pressure fluid fed from the first nozzle 411 is at a level sufficient to generate cavitation jet in air described later. Specifically, the pressure of the high pressure fluid is defined in a range of 20 MPa to 40 MPa. A pressure of the low pressure fluid fed from the second nozzle 412 is at a level sufficient to generate cavitation jet in air described later. Specifically, the pressure of the low pressure fluid is defined in a range of 0.03 MPa to 0.07 MPa.

The cleaning nozzle moving unit 44 is controlled by the controller 46 to move the cleaning nozzle 41 in a direction along the surface of each of the work rolls 2 (i.e., the axial direction of each of the work rolls 2) and to move the cleaning nozzle 41 so as to change a distance X between the cleaning nozzle 41 and the work roll 2. Specifically, as shown in FIG. 2, the cleaning nozzle moving unit 44 moves the cleaning nozzle 41 in the axial direction of the work roll 2 using a nozzle support 441 that supports the cleaning nozzle 41, a nozzle-moving lead screw 442 that penetrates the nozzle support 441 while being screwed to the nozzle support 441, and a drive section 443 that rotates the nozzle-moving lead screw 442 in forward and reverse directions. On the other hand, an actuator 444 fixed to the nozzle support 441 and supporting the cleaning nozzle 41 moves the cleaning nozzle 41 toward or away from the work roll 2, whereby the distance X is changeable.

Description of Cleaning Method

Next, a cleaning method of the work roll 2 will be described.

As shown in FIG. 3, by squirting the low pressure fluid through the second nozzle 412 of the cleaning nozzle 41 and the high pressure fluid through the first nozzle 411 thereof, cavitation jet is formed and sprayed over the surface of the work roll 2. At this time, the actuator 444 appropriately adjusts the distance X between the tip end of the cleaning nozzle 41 and the surface of the work roll 2. The driving section 443 of the cleaning nozzle moving unit 44 moves the nozzle support 441 in the axial direction of the work roll 2, thereby cleaning the work roll 2 in full width.

For the cleaning, the controller 46 adjusts the distance X and a pressure PH of the high pressure fluid and a pressure PL of the low pressure fluid which are squirted from the cleaning nozzle 41, based on the detected adhesion amount of sticking substances on the surface of the work roll 2.

Figure 4:
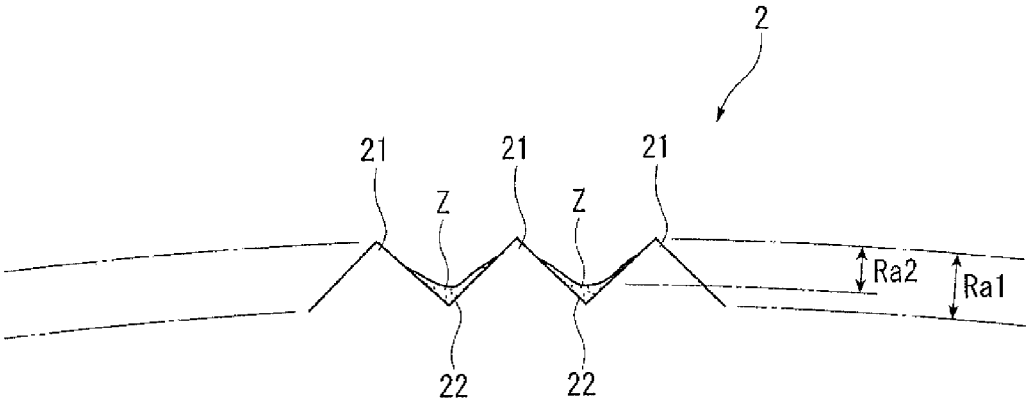
FIG. 4 is an enlarged cross section showing a work roll of the skin pass mill.

The adhesion amount of sticking substances on the surface of the work roll 2 is detected by the detector 45 based on a change in the surface color of the work roll 2 which is caused by accumulation of zinc powders Z in concave portions 22 of the work roll 2 and a change in a height difference between convex portions 21 and the concave portions 22 of the work roll 2 as shown in FIG. 4. In other words, when the zinc powders Z are accumulated in the concave portions 22 of the work roll 2, a roughness Ra1 of the work roll 2 is decreased to a roughness Ra2, which causes decrease in roughness to be transferred on a galvanized steel strip S. Accordingly, in order to remove the zinc powders Z accumulated in the concave portions 22, the controller 46 adjusts the distance X, the pressure PH of the high pressure fluid and the pressure PL of the low pressure fluid as follows.

The controller 46 controls the second adjusting unit 433 to start supplying the low pressure fluid to the second nozzle 412 and controls the first adjusting unit 423 to start supplying the high pressure fluid to the first nozzle 411, whereby the low pressure fluid and the high pressure fluid are simultaneously squirted respectively from the second squirt hole 414 and the first squirt hole 413. In this operation, the controller 46 controls the pressure PH of the high pressure fluid fed from the first pumping unit 422 within a range shown in the graph of FIG. 5 based on the distance X. On the other hand, the controller 46 controls the pressure PL of the low pressure fluid in a range of 0.03 MPa to 0.07 MPa (center pressure PL=0.05 MPa). By thus simultaneously squirting the high pressure fluid and the low pressure fluid which are different in pressure and speed, cavitation jet in air is formed and sprayed over the surface of the work roll 2. When bubbles in the cavitation jet in air is blown out on the surface of the work roll 2, an impact pressure of the cleaning fluid is reinforced, so that sticking substances adhered or accumulated in the concave portions can be removed by such a high cleaning force.

Figure 5:
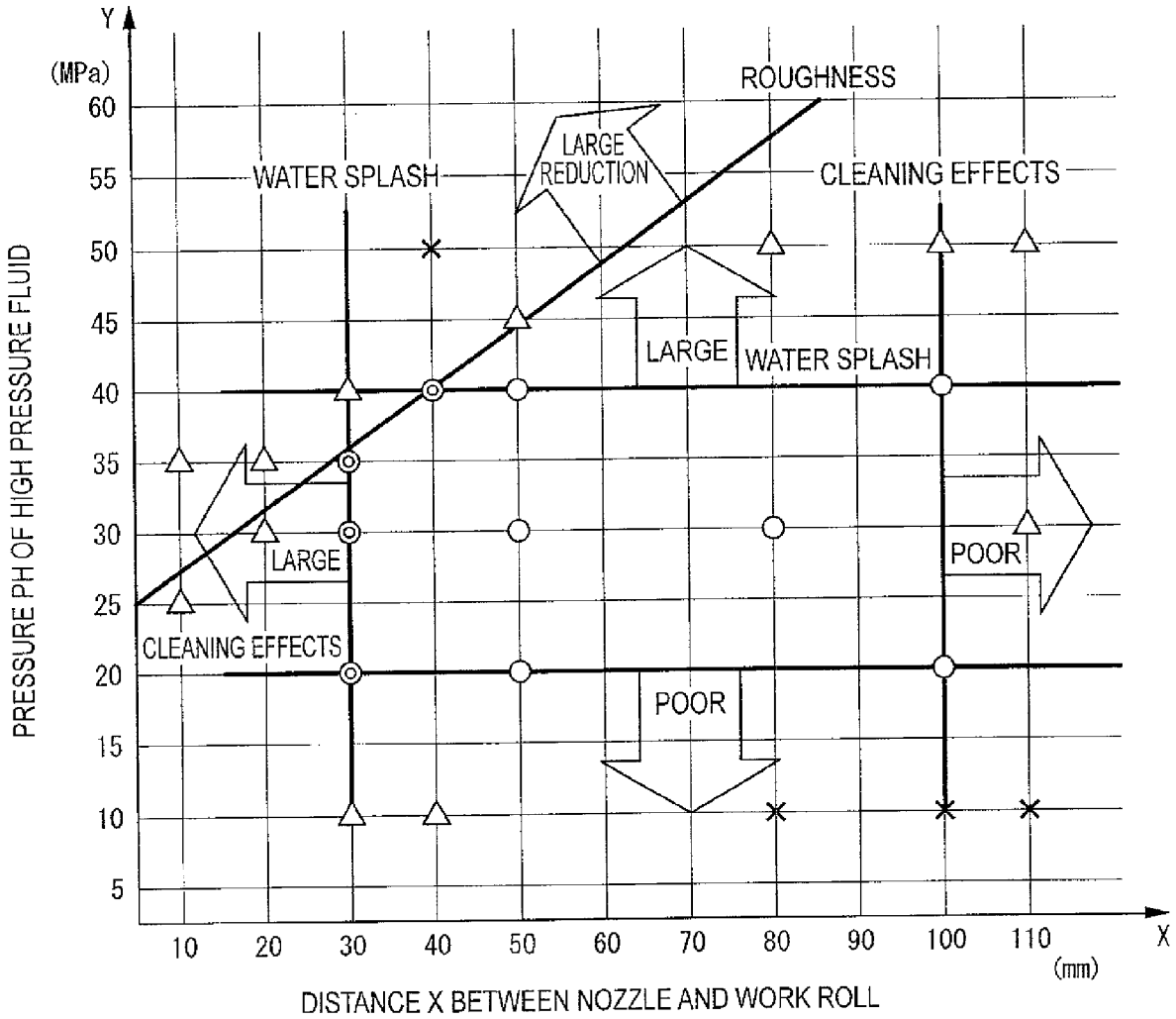
FIG. 5 is a graph showing a setting range of the cleaning device.

The relationship between the distance X and the pressure PH of the high pressure fluid is shown in FIG. 5, in which the distance X is set in a range of 30 mm to 100 mm and the pressure PH of the high pressure fluid is set in a range of 20 MPa to 40 MPa. Further, the distance X and the pressure PH are set so as to satisfy the following formula (1).

$$PH \leq 0.375X + 25 \quad (1)$$

The above relationship between the distance X and the pressure PH of the high pressure fluid is set according to later-described Examples. By generating cavitation jet in air based on this setting, the following advantages are obtainable in the cleaning device 4 of this exemplary embodiment.

Advantages of Embodiment(s)

When the distance X is set at at least 30 mm, interference between the work roll 2 and the cleaning nozzle 41 is avoidable not to affect the rolling step and generation of cavitation is not disturbed by rebounding of splashing fluid. When the distance X is set at at most 100 mm, the squirted fluid is suppressed from splashing to save the amount of the fluid in use and costs for collecting the fluid and cleaning are kept low, and additionally, when PH (squirt pressure of high pressure fluid) is in a range of 20 MPa to 40 MPa, a cleaning function is not reduced. When the pressure PH of the high pressure fluid is set at at least 20 MPa, adhered zinc can be cleaned off and cleaning advantages are further ensured. When the pressure PH is set at at most 40 MPa, the fluid is further suppressed from splashing to reduce a possibility to damage the surface roughness of the work roll 2. Accordingly, the generation of cavitation jet in air on the surface of the work roll 2 provides a higher cleaning force than squirting of only the high pressure fluid, so that sticking substances on the surface of the work roll 2 are reliably removable. An appropriate setting of the distance X and the pressure PH of the high pressure fluid enables an efficient removal of sticking substances while keeping the surface roughness of the work roll 2.

As described above, since an efficient removal of sticking substances while keeping the surface roughness of the work roll 2 is possible according to the cleaning method using the cleaning device 4, a replacement frequency of the work roll 2 is reduced to increase a rolling efficiency of the skin pass mill 1. Accordingly, steel-roughness requisite to a hot-dip galvanized steel strip after the skin pass mill rolling can be continuously provided, thereby efficiently manufacturing a galvanized steel strip having secured press moldability and clarity requisite for use as an automobile member.

Modification(s)

It should be understood that the invention is not limited to the above-described exemplary embodiment(s) but includes modifications as long as such modifications are compatible with the invention.

For instance, the cleaning nozzle 41 described in the above exemplary embodiment may be provided by plural ones. The plural cleaning nozzles may perform at least one of movement and oscillation in the axial direction of the work roll 2.

The mechanism to move the nozzle support 441 of the cleaning nozzle moving unit 44 described in the above exemplary embodiment may not be provided, but the cleaning nozzle 41 may be provided by a larger number of ones so as to eliminate blind areas in spraying over the surface of the work roll 2.

The cleaning device and cleaning method in the exemplary embodiment of the invention are also applicable to a steel strip process line (e.g., a continuous annealing line) other than the hot-dip continuous galvanizing line, and further applicable to a roll of the rolling machine other than the skin pass mill. Moreover, the cleaning device and cleaning method in the exemplary embodiment of the invention are also applicable for removing sticking substance on a rolling roll other than the work roll. In the hot-dip continuous galvanizing line, the cleaning device and cleaning method in the exemplary embodiment of the invention are also applicable for cleaning a roll on which zinc powders are adhered, such as a TOP roll provided on a downstream of a zinc-coating machine.

Although the cleaning nozzle is disposed near the delivery side of the work roll in the above exemplary embodiment, the cleaning nozzle may be disposed near the entry side of the work roll, or disposed at other positions. A setting position and the number of the setting positions of the cleaning nozzle are not particularly limited.

EXAMPLES

An Example of the invention will be described with reference to FIG. 5 and Table 1.

Herein, using a skin pass mill for the hot-dip galvanizing line similar to the skin pass mill 1 described in the above exemplary embodiment, skin pass mill rolling was performed under the following conditions. With parameters including the distance X and the pressure PH of the high pressure fluid, the replacement frequency of the work roll and accumulated-zinc removal force and decrease in roughness of the work roll were examined and evaluated. Note that "conventional" in Table 1 refers to a cleaning method of removing sticking substances such as zinc powers by scratching the surface of the work roll using a contact-type brush. In Table 1, Examples encompassed in the scope of the invention are No. 6 to 8, 11, 13 to 15, 18, 21 and 22 and No. 1 to 5, 9, 10, 12, 16, 17, 19, 20 and 23 to 26 are Comparatives.

Galvanized steel strip: strip thickness of 0.5 mm to 1.0 mm×strip width of 1200 mm to 1600 mm Coating thickness: 140 g/m$^2$ to 220 g/m$^2$ (both surfaces)

Line speed: 110 mpm to 150 mpm

Rolling force: 250 ton to 400 ton

Distance X: 10 mm to 110 mm

Pressure PH of high pressure fluid: 10 MPa to 50 MPa

Pressure PL of low pressure fluid: 0.05 MPa

TABLE 1

| | | nozzle water pressure (MPa) | | work roll | | | |
|---|---|---|---|---|---|---|---|
| No. | X (mm) | high pressure | low pressure | WR replacement frequency | zinc removal rate | decrease in roughness | total evaluation |
| brush cleaning | — | — | — | 6 | extra weak | extra large | X |
| 1 | 10 | 25 | 0.05 | 1 | small | small | Δ |
| 2 | 10 | 35 | 0.05 | 2 | mediate | mediate | Δ |
| 3 | 20 | 30 | 0.05 | 1 | small | small | Δ |
| 4 | 20 | 35 | 0.05 | 3 | mediate | mediate | Δ |
| 5 | 30 | 10 | 0.05 | 1 | small | small | Δ |
| 6 | 30 | 20 | 0.05 | 0 | extra large | small | ◎ |
| 7 | 30 | 30 | 0.05 | 0 | extra large | small | ◎ |
| 8 | 30 | 35 | 0.05 | 0 | extra large | small | ◎ |
| 9 | 30 | 40 | 0.05 | 3 | extra large | large | Δ |
| 10 | 40 | 10 | 0.05 | 2 | small | small | Δ |
| 11 | 40 | 40 | 0.05 | 0 | extra large | small | ◎ |
| 12 | 40 | 50 | 0.05 | 4 | extra large | large | X |
| 13 | 50 | 20 | 0.05 | 0 | large | small | ○ |
| 14 | 50 | 30 | 0.05 | 0 | large | small | ○ |
| 15 | 50 | 40 | 0.05 | 0 | large | small | ○ |
| 16 | 50 | 45 | 0.05 | 1 | large | mediate | Δ |
| 17 | 80 | 10 | 0.05 | 0 | weak | small | X |
| 18 | 80 | 30 | 0.05 | 0 | mediate | small | ○ |
| 19 | 80 | 50 | 0.05 | 2 | large | mediate | Δ |
| 20 | 100 | 10 | 0.05 | 0 | weak | small | X |
| 21 | 100 | 20 | 0.05 | 0 | mediate | small | ○ |
| 22 | 100 | 40 | 0.05 | 0 | large | small | ○ |
| 23 | 100 | 50 | 0.05 | 0 | mediate | mediate | Δ |
| 24 | 110 | 10 | 0.05 | 0 | weak | small | X |
| 25 | 110 | 30 | 0.05 | 0 | small | small | Δ |
| 26 | 110 | 50 | 0.05 | 0 | mediate | small | Δ |

Evaluation is made in terms of a replacement frequency of the work roll in the following manner. With a proviso that a course of production of a predetermined rolling amount (e.g., 3000 ton/3 days of a hot-dip galvanized steel strip) in the same setting is defined as one chance, it is initially evaluated whether the work roll is not replaced during the one chance. Next, when the work roll is replaced, the replacement frequency is evaluated: the lower the replacement frequency is, the better the evaluation is. Accumulated zinc removal force refers to removal force (i.e., cleaning force) to remove zinc powders that are accumulated in the concave portions of the work roll during operation (i.e., generation of zinc accumulation). The larger the accumulated zinc removal force is, the more excellent the evaluation is. Although the reduction in roughness of the work roll is caused by wear (i.e., reduction in roughness) of the concave portions of the work roll by a typical rolling, the concave portions are further worn by cleaning. Accordingly, the less the wear of the concave portions by the cleaning is, the more excellent the evaluation is. Note that, in a conventional brush cleaning, since the concave portions are significantly worn (i.e., roughness is significantly reduced) by contact of a brush on the surface of the work roll, the brush cleaning is evaluated as × in Table 1.

As shown in Table 1, in Examples (No. 6 to 8, 11, 13 to 15, 18, 21 and 22), the replacement of the work roll for one chance was unnecessary (i.e., the replacement frequency was zero), accumulated-zinc removal force was large and reduction in roughness of the work roll was small. Particularly in the distance X of 30 mm, the higher the pressure PH of the high pressure fluid was, the larger the cleaning force and the accumulated-zinc removal force were. Further, under the conditions of the distance X being 30 mm and the pressure PH being 20 to 40 MPa, a favorable cleaning force was obtained and the reduction in roughness of the work roll was as small as that in other Examples, which did not affect the replacement of the work roll. On the other hand, in Comparatives (No. 5 and 9) in which the distance X was 30 mm, when the pressure PH of the high pressure fluid was low, the accumulated-zinc removal force was small and cleaning performance was insufficient. When the pressure PH was high (40 MPa), since the roughness of the work roll was reduced, the replacement frequency of the work roll was increased, which was inefficient and uneconomical.

In view of the above, in Examples No. 6 to 8, 11, 13 to 15, 18, 21 and 22, the replacement of the work roll for one chance was unnecessary and favorable cleaning effects were obtained, so that these cleaning conditions were judged to be favorable.

On the other hand, in Comparatives No. 9 and 12, the replacement of the work roll was necessary and a splash of the fluid was confirmed. In Comparatives No. 5, 10 and 17, the cleaning performance was insufficient since the pressure PH of the high pressure fluid was low. In Comparative No.

12, although the cleaning performance was high, the replacement frequency of the work roll was increased since the concave portions on the surface of the work roll were worn to significantly reduce the roughness. In Comparatives No. 24 and 25 in which the distance X was large (X=110 mm), the cleaning performance was insufficient. In comparative No. 26, although cleaning effects were confirmed, a large installation space became necessary and was thus uneconomical.

Consequently, when the distance X was in the range of 30 mm to 100 mm and the pressure PH of the high pressure fluid was in the range of 20 MPa to 40 MPa (i.e., the cleaning conditions in Examples No. 6 to 8, 11, 13 to 15, 18, 21 and 22) and the formula (1) was satisfied, advantages of maintaining the cleaning performance and the roughness of the surface of the work roll were observed.

Although the best configuration, the method and the like for carrying out the invention are disclosed in the above description, the invention is not limited to this disclosure. In other words, while the invention has been particularly explained and illustrated mainly in relation to a specific embodiment, a person skilled in the art could make various modifications in terms of shape, material, quantity or other particulars to the above described embodiment without deviating from the technical idea or any object of the present invention.

Accordingly, any descriptions of shape or material or the like disclosed above are given as examples to enable easy understanding of the invention, and do not limit the invention, so that descriptions using names of components, with any such limitations of shape or material or the like removed in part or whole, are included in the invention.

The invention claimed is:

1. A cleaning device for a rolling roll, the cleaning device comprising a cavitation nozzle that is used for cleaning a work roll used in a rolling mill, wherein in order to clean zinc adhered to a surface of the work roll while keeping surface roughness of the work roll, a distance X between a tip end of the cavitation nozzle and the surface of the work roll is set in a range of 30 mm to 40 mm;

a pressure PH of high pressure fluid squirted from the cavitation nozzle is set in a range of 20 MPa to 40 MPa;

a pressure PL of low pressure fluid squirted from the cavitation nozzle simultaneously with the high pressure fluid is set in a range of 0.03 MPa to 0.07 MPa; and the pressure PH of the high pressure fluid satisfies $PH \leq 0.5X+20$.

2. The cleaning device for a rolling roll according to claim 1, wherein the cavitation nozzle comprises a first nozzle and a second nozzle, the high pressure fluid is squirted from the first nozzle, and the low pressure fluid is squirted from the second nozzle simultaneously with the high pressure fluid.

3. The cleaning device for a rolling roll according to claim 1, wherein the cavitation nozzle comprises a first nozzle and a second nozzle, the second nozzle surrounding the first nozzle, the high pressure fluid is squirted from the first nozzle, and the low pressure fluid is squirted from the second nozzle simultaneously with the high pressure fluid.

4. A method of cleaning a work roll of a rolling roll using a cavitation nozzle, the method comprising:

setting a distance X between a tip end of the cavitation nozzle and a surface of the work roll at a predetermined distance in a range of 30 mm to 40 mm;

setting a pressure PH of high pressure fluid squirted from the cavitation nozzle at a predetermined value in a range of 20 MPa to 40 MPa;

setting a pressure PL of low pressure fluid squirted from the cavitation nozzle simultaneously with the high pressure fluid at a predetermined value in a range of 0.03 MPa to 0.07 MPa; and cleaning zinc adhered on the surface of the work roll while keeping roughness of the surface of the work roll, by squirting the high pressure fluid from the cavitation nozzle in which the pressure PH of the high pressure fluid is set to satisfy $PH \leq 0.5X+20$.

5. The method of cleaning the rolling roll according to claim 4, further comprising:

moving the cavitation nozzle along the surface of the work roll while keeping the distance X for cleaning.

6. The method of cleaning the rolling roll according to claim 4, wherein the cavitation nozzle comprises a first nozzle and a second nozzle, the high pressure fluid is squirted from the first nozzle, the low pressure fluid is squirted from the second nozzle simultaneously with the high pressure fluid.

7. The method of cleaning the rolling roll according to claim 4, wherein the cavitation nozzle comprises a first nozzle and a second nozzle, the second nozzle surrounding the first nozzle, the high pressure fluid is squirted from the first nozzle, the low pressure fluid is squirted from the second nozzle simultaneously with the high pressure fluid.

* * * * *